US007856814B2

(12) United States Patent
Nakagome et al.

(10) Patent No.: US 7,856,814 B2
(45) Date of Patent: Dec. 28, 2010

(54) EXHAUST DEVICE FOR MOTORCYCLE

(75) Inventors: Hiroshi Nakagome, Saitama (JP); Masashi Furuya, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 278 days.

(21) Appl. No.: 11/896,083

(22) Filed: Aug. 29, 2007

(65) Prior Publication Data

US 2008/0053066 A1 Mar. 6, 2008

(30) Foreign Application Priority Data

Sep. 1, 2006 (JP) ..... 2006-237669

(51) Int. Cl.
*F01N 7/00* (2006.01)

(52) U.S. Cl. ..... 60/324; 60/312

(58) Field of Classification Search ..... 60/276, 60/287, 288, 324, 313, 312, 323
See application file for complete search history.

(56) References Cited

U.S. PATENT DOCUMENTS 3,938,330 A * 2/1976 Nakajima et al. ..... 60/294
4,785,626 A * 11/1988 Shiraishi ..... 60/313
4,795,420 A * 1/1989 Sakurai et al. ..... 60/313
7,171,804 B2 * 2/2007 Terashima ..... 60/323
2002/0050415 A1 * 5/2002 Kawamoto ..... 180/219
2006/0242952 A1 * 11/2006 Muramatsu et al. ..... 60/299

FOREIGN PATENT DOCUMENTS

JP 2005-83358 A 3/2005

* cited by examiner

*Primary Examiner*—Thomas E Denion
*Assistant Examiner*—Diem Tran
(74) *Attorney, Agent, or Firm*—Birch, Stewart, Kolasch & Birch LLP

(57) ABSTRACT

To provide an exhaust device for a motorcycle for suppressing an exhaust resistance due to the thickness of an exhaust control valve. An exhaust device for a motorcycle is provided for an engine having a plurality of cylinders. A plurality of upstream exhaust pipes are respectively connected to exhaust ports for the cylinders with an exhaust control valve provided in the downstream exhaust pipe. A separator is provided in the exhaust manifold portion for separating the flows of exhaust gas. The exhaust control valve is located on the downstream side of the separator so that a main surface of the exhaust control valve in its fully open condition becomes substantially parallel to a main surface of the separator.

20 Claims, 11 Drawing Sheets

EXHAUST DEVICE FOR MOTORCYCLE

CROSS-REFERENCE TO RELATED APPLICATIONS

The present application claims priority under 35 USC 119 to Japanese Patent Application No. 2006-237669 filed on Sep. 1, 2006 the entire contents of which are hereby incorporated by reference.

BACKGROUND OF THE INVENTION

1. Field of the Invention

The present invention relates to an exhaust device for a motorcycle including an engine having a plurality of cylinders.

2. Description of Background Art

In a conventional exhaust device for a motorcycle including an engine having a plurality of cylinders, an exhaust control valve is provided in an exhaust passage extending from a plurality of exhaust pipes connected to exhaust ports for the cylinders to an exhaust muffler, thereby controlling a sectional area of the exhaust passage. The exhaust control valve is provided to block valve operating noises generated from the cylinders and also to obtain exhaust control characteristics according to engine speed. The exhaust control valve is a so-called butterfly valve rotatably supported to a pivot shaft so that a main surface of the butterfly valve is rotated about the axis of rotation of the pivot shaft to adjust the degree of opening of the exhaust passage.

Further, it is known that a separator is provided on the upstream side of the exhaust control valve at a portion of the exhaust passage where two exhaust pipes are united to one exhaust pipe to join the flows of exhaust gas. The separator functions to gradually join the flows of exhaust gas from the two exhaust pipes toward the one exhaust pipe.

In the fully open condition of the exhaust control valve, the main surface of the exhaust control valve is substantially parallel to the flowing direction of the exhaust gas in the exhaust passage. Further, the main surface of the exhaust control valve in its fully open condition is substantially perpendicular to a main surface of the separator. See, for example Japanese Patent Laid-open No. 2005-83358.

When the exhaust gas flows in the exhaust passage in the fully open condition of the exhaust control valve, it is preferable to minimize an exhaust resistance against the flow of exhaust gas in the exhaust passage. However, in the above conventional configuration using the butterfly valve, when the exhaust gas having passed through the separator flows through the butterfly valve, the flow of exhaust gas is hindered by the thickness of the butterfly valve, causing an increased exhaust resistance.

SUMMARY AND OBJECTS OF THE INVENTION

It is accordingly an object of an embodiment of the present invention to provide an exhaust device for a motorcycle that can suppress an exhaust resistance due to the thickness of an exhaust control valve.

In accordance with an embodiment of the present invention, there is provided an exhaust device for a motorcycle including an engine having a plurality of cylinders, a plurality of upstream exhaust pipes respectively connected to exhaust ports for the cylinders, an exhaust control valve provided in the downstream exhaust pipe, and a separator provided in the exhaust manifold portion of the exhaust pipe for separating the flows of exhaust gas. The exhaust control valve is located on the downstream side of the separator so that a main surface of the exhaust control valve in its fully open condition becomes substantially parallel to a main surface of the separator.

With this configuration, the amount of exhaust gas striking the thickness of the exhaust control valve can be reduced, so that the exhaust gas smoothly flows through the exhaust control valve with a low exhaust resistance.

Preferably, the exhaust control valve is rotatably supported to a pivot shaft extending diametrically through the downstream exhaust pipe located on the downstream side of the exhaust manifold portion, and the axis of rotation of the pivot shaft extends parallel to an extension plane of the main surface of the separator.

With this configuration, when the pivot shaft is rotated to obtain the fully open condition of the exhaust control valve, the main surface of the exhaust control valve becomes parallel to the main surface of the separator.

According to an embodiment of the present invention, in the fully open condition of the exhaust control valve provided on the downstream side of the separator, the main surface of the exhaust control valve is substantially parallel to the main surface of the separator. Accordingly, the amount of exhaust gas striking the thickness of the exhaust control valve can be reduced, so that the exhaust gas smoothly flows through the exhaust control valve with a low exhaust resistance. As a result, the exhaust efficiency in the fully open condition of the exhaust control valve can be improved.

Further, the exhaust control valve is rotatably supported to the pivot shaft extending diametrically through the downstream exhaust pipe located on the downstream side of the exhaust manifold portion, and the axis of rotation of the pivot shaft extends parallel to the extension plane of the main surface of the separator. Accordingly, the main surface of the exhaust control valve can be easily made parallel to the main surface of the separator by simply rotating the pivot shaft.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
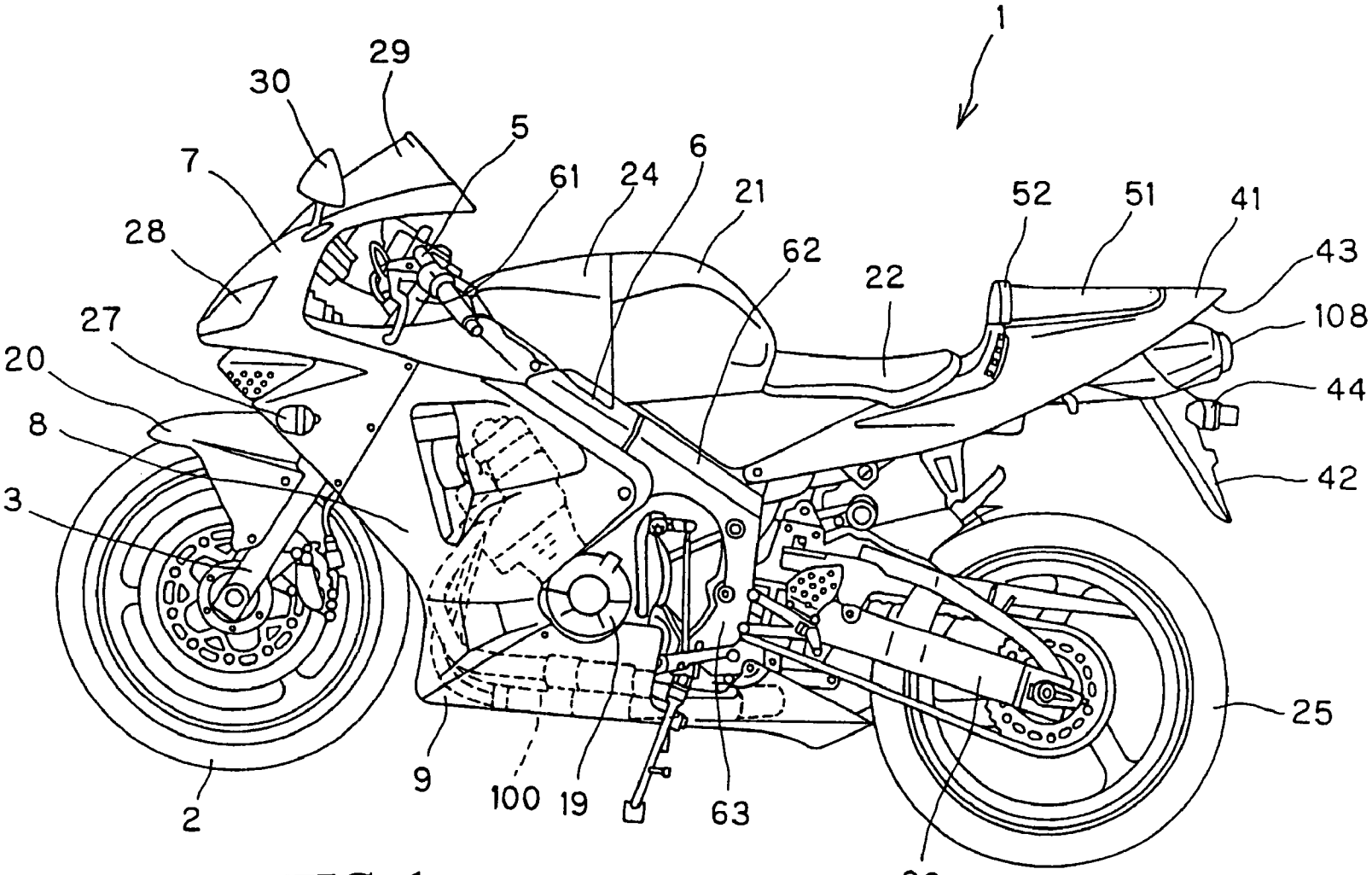
FIG. 1 is a general side view of a motorcycle including an exhaust device according to a preferred embodiment of the present invention.

A preferred embodiment of the present invention will now be described with reference to the drawings. FIG. 1 is a general side view of a motorcycle 1 including an exhaust device according to a preferred embodiment of the present invention. In the following description, the terms of "upper," "lower," "front," and "rear" mean the directions with respect to the position of the motorcycle 1 shown in FIG. 1, and the terms of "right" and "left" mean the directions as viewed from a rider on the motorcycle 1.

As shown in FIG. 1, the motorcycle 1 includes a body frame 6, which is composed of a head pipe 61, a pair of right and left main frames 62 extending rearward from the head pipe 61 so as to be inclined downwardly, a pair of right and left pivot plates 63 joined to the rear portions of the right and left main frames 62, and a cross member (not shown) for horizontally connecting the right and left pivot plates 63.

As shown in FIG. 1, a front fork 3 is connected to the head pipe 61 of the body frame 6. A front wheel 2 having a hydraulic disc brake is rotatably supported to the lower ends of the front fork 3, and a front fender 20 is provided above the front wheel 2. The front fender 20 is supported to the front fork 3. A steering handle 5 is mounted to the upper end of the front fork 3.

A water-cooled, in-line four-cylinder, transverse engine 19 is mounted to the central portion of the body frame 6 on the lower side thereof. A pair of right and left middle cowls 8 are provided on the right and left sides of the engine 19. The middle cowls 8 are detachably mounted to the body frame 6 so as to be continuously joined to an upper cowl 7. Mounted to the upper cowl 7 are a dual headlight 28, a windshield 29, a pair of right and left front turn signal lamps 27, and a pair of right and left rear-view mirrors 30. Further, an exhaust device 100 is provided below the engine 19 so as to be routed from the engine 19 along the under side of the vehicle body. The exhaust device 100 will be hereinafter described in detail.

A pair of right and left lower cowls 9 are provided below the engine 19 so as to cover the right and left sides of the exhaust device 100. The right and left lower cowls 9 are detachably mounted to the body frame 6 so as to be continuously joined to the right and left middle cowls 8. A fuel tank 21 is mounted on the upper side of the body frame 6 above the engine 19, and a front seat 22 is provided on the rear side of the fuel tank 21. A half cover 24 is provided so as to cover the front half portion of the fuel tank 21. A rear seat (pillion seat) 51 is provided on the rear side of the front seat 22. A rear cowl 41 and a rear fender 42 are provided below the rear seat 51. A stop lamp 43 and a pair of right and left rear turn signal lamps 44 are mounted on the rear fender 42.

As shown in FIG. 1, a swing arm (rear fork) 23 is pivotably supported to a rear lower portion of the body frame 6, and a chain-driven type rear wheel 25 having a hydraulic disc brake is rotatably supported to the rear ends of the swing arm 23 at a position below the rear fender 42.

Figure 2:
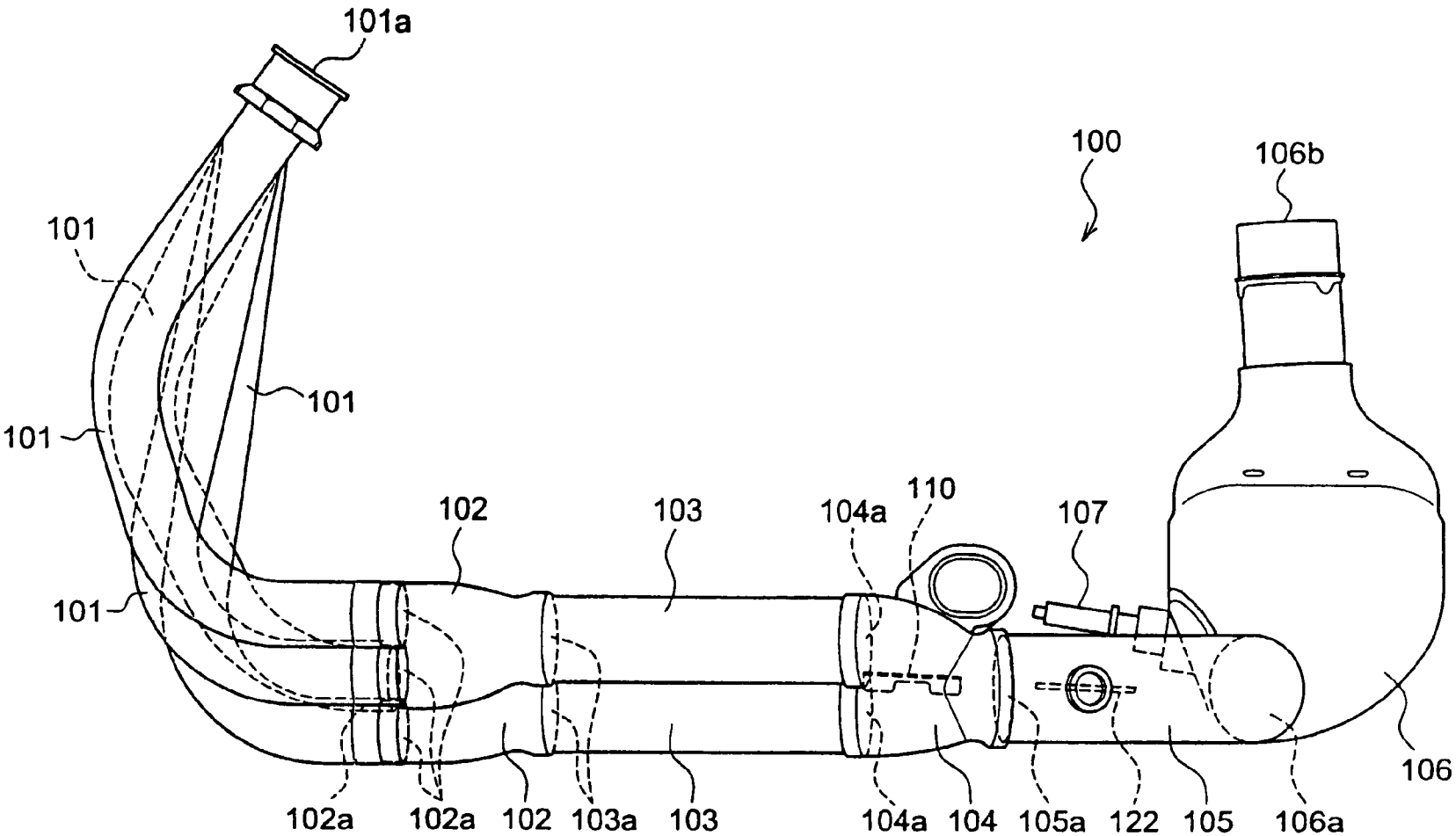
FIG. 2 is a left side view of the exhaust device according to a preferred embodiment of the present invention.
Figure 3:
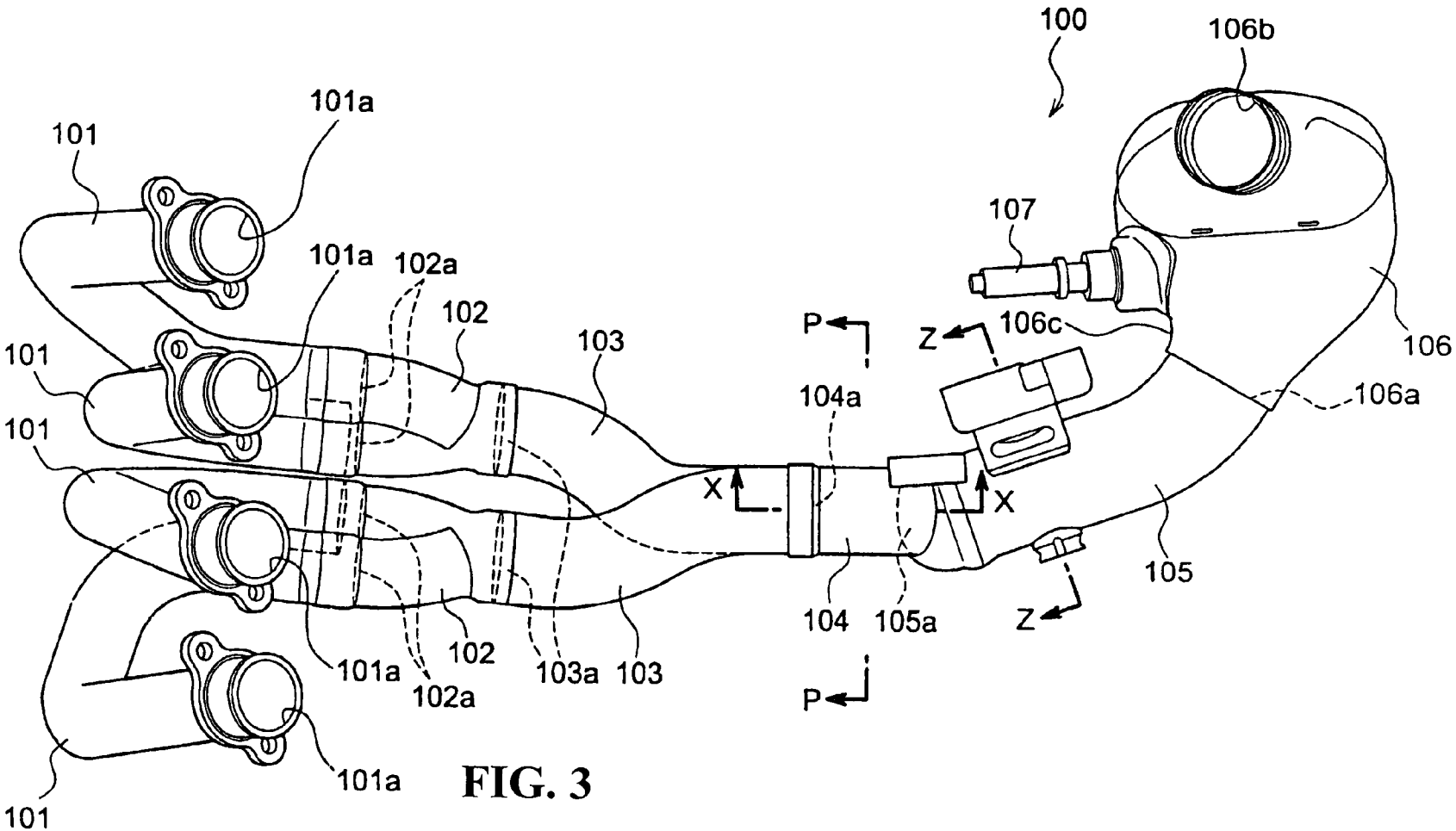
FIG. 3 is a top plan view of the exhaust device of FIG. 2.

FIG. 2 is a left side view of the exhaust device 100, and FIG. 3 is a top plan view of the exhaust device 100.

As shown in FIGS. 2 and 3, the exhaust device 100 includes four upstream exhaust pipes 101 extending from the engine 19, two upstream exhaust manifold portions 102 connected to the four upstream exhaust pipes 101, two intermediate exhaust pipes 103 extending from the two upstream exhaust manifold portions 102, a downstream exhaust manifold portion 104 connected to the two intermediate exhaust pipes 103, a downstream exhaust pipe 105 extending from the downstream exhaust manifold portion 104, and a bent exhaust pipe 106 connected to the downstream exhaust pipe 105 and bent upwardly. Although not shown, an exhaust pipe is connected to the bent exhaust pipe 106 and bent rearwardly. An exhaust muffler 108 (see FIG. 1) is connected to this exhaust pipe and pointed to the rear side of the vehicle body.

Each of the upstream exhaust pipes 101, the intermediate exhaust pipes 103, the downstream exhaust pipe 105, and the bent exhaust pipe 106 has a hollow cylindrical shape.

The four upstream exhaust pipes 101 respectively have inlet openings 101*a*, and these four inlet openings 101*a* are respectively connected to four exhaust ports formed in a cylinder head of the engine 19 (see FIG. 1). The four exhaust ports respectively correspond to the four cylinders of the engine 19. As shown in FIG. 2, the four upstream exhaust pipes 101 extend downwardly from the respective inlet openings 101*a* toward the front lower side of the engine 19 (see FIG. 1) and further extend substantially horizontally rearwardly below the engine 19. The four upstream exhaust pipes 101 respectively have outlet openings at the downstream ends.

Each of the two upstream exhaust manifold portions 102 functions to unite two of the four upstream exhaust pipes 101 into one of the two intermediate exhaust pipes 103. As shown in FIGS. 2 and 3, each upstream exhaust manifold portion 102 has two inlet openings 102*a* respectively connected to the outlet openings of two of the four upstream exhaust pipes 101, and extends substantially horizontally rearwardly from these two inlet openings 102*a*. Each upstream exhaust manifold portion 102 has an outlet opening at the downstream end. As shown in FIG. 3, the two upstream exhaust manifold portions 102 are arranged adjacent to each other in the lateral direction of the vehicle body with a laterally central line X interposed therebetween. As shown in FIG. 2, the left upstream exhaust manifold portion 102 is arranged at a level higher than the right upstream exhaust manifold portion 102.

As shown in FIGS. 2 and 3, each intermediate exhaust pipe 103 has an inlet opening 103*a* connected to the outlet opening of each upstream exhaust manifold portion 102, and extends rearwardly from the inlet opening 103*a*. Each intermediate exhaust pipe 103 has an outlet opening at the downstream end. More specifically, as shown in FIG. 2, the two intermediate exhaust pipes 103 are arranged at different levels and extend substantially horizontally rearwardly from the respective inlet openings 103*a* as viewed in side elevation, and as shown in FIG. 3, the two intermediate exhaust pipes 103 are gently curved toward the laterally central line X so that the laterally central line X coincides with the center line extending between the two intermediate exhaust pipes 103 as viewed in a plan view.

The downstream exhaust manifold portion 104 functions to unite the two intermediate exhaust pipes 103 into the single downstream exhaust pipe 105. As shown in FIGS. 2 and 3, the downstream exhaust manifold portion 104 has two inlet openings 104*a* respectively connected to the outlet openings of the two intermediate exhaust pipes 103, and extends substantially horizontally rearwardly from the inlet openings 104*a*. The downstream exhaust manifold portion 104 has an outlet opening at the downstream end. As shown in FIG. 2, the two inlet openings 104*a* are arranged adjacent to each other in the vertical direction. Further, a separator 110 to be hereinafter described in detail is provided inside the downstream exhaust manifold portion 104.

As shown in FIGS. 2 and 3, the downstream exhaust pipe 105 has an inlet opening 105*a* connected to the outlet opening of the downstream exhaust manifold portion 104, and extends rearwardly from the inlet opening 105*a* so as to be gently curved to the right side as viewed in a plan view. In particular, the rear portion of the downstream exhaust pipe 105 is further curved to the right side as shown in FIG. 3. The downstream exhaust pipe 105 has an outlet opening at the downstream end. Further, an exhaust control valve 122 to be hereinafter described in detail is provided inside the downstream exhaust pipe 105.

As shown in FIGS. 2 and 3, the bent exhaust pipe 106 has an inlet opening 106*a* connected to the outlet opening of the downstream exhaust pipe 105, and extends rearwardly from the inlet opening 106*a* so as to be bent upwardly and curved to the right. The bent exhaust pipe 106 has an outlet opening 106*b* at the downstream end is formed as the upper end as shown in FIG. 2. The bent exhaust pipe 106 has an expanded body portion between the inlet opening 106*a* and the outlet opening 106*b*.

The bent exhaust pipe 106 is provided with an $O_2$ sensor 107 at an inside portion 106*c* of a bent portion formed rearwardly from the inlet opening 106*a* so as to be bent upwardly and curved to the right. The $O_2$ sensor 107 functions to detect the concentration of oxygen remaining in the exhaust gas. For example, the $O_2$ sensor 107 is configured so as to monitor whether or not combustion is performed at a stoichiometric air-fuel ratio in the engine and to feed back the result of this monitoring to a computer. Conventionally, this $O_2$ sensor 107 is provided on a straight portion of an exhaust pipe, causing a problem such that condensate staying in the exhaust pipe may splash on a detecting portion of the $O_2$ sensor. According to this preferred embodiment, however, the $O_2$ sensor 107 is provided on the inside portion 106*c* of the bent exhaust pipe 106 in such a manner that a detecting portion (not shown) of the $O_2$ sensor 107 is exposed to the inner wall of the inside portion 106*c*, so as to prevent the splash of condensation.

The exhaust pipes 101, 103, and 105, the manifold portions 102 and 104, and the bent exhaust pipe 106 are connected by welding so as to ensure hermeticity. With the above configuration of the exhaust device 100, the exhaust gas is passed through the four upstream exhaust pipes 101, the two upstream exhaust manifold portions 102, the two intermediate exhaust pipes 103, the downstream exhaust manifold portion 104, and the downstream exhaust pipe 105 in this order to the bent exhaust pipe 106. Subsequently, the exhaust gas is discharged from the outlet opening 106*b* of the bent exhaust pipe 106 to reach the exhaust muffler 108.

Figure 4:
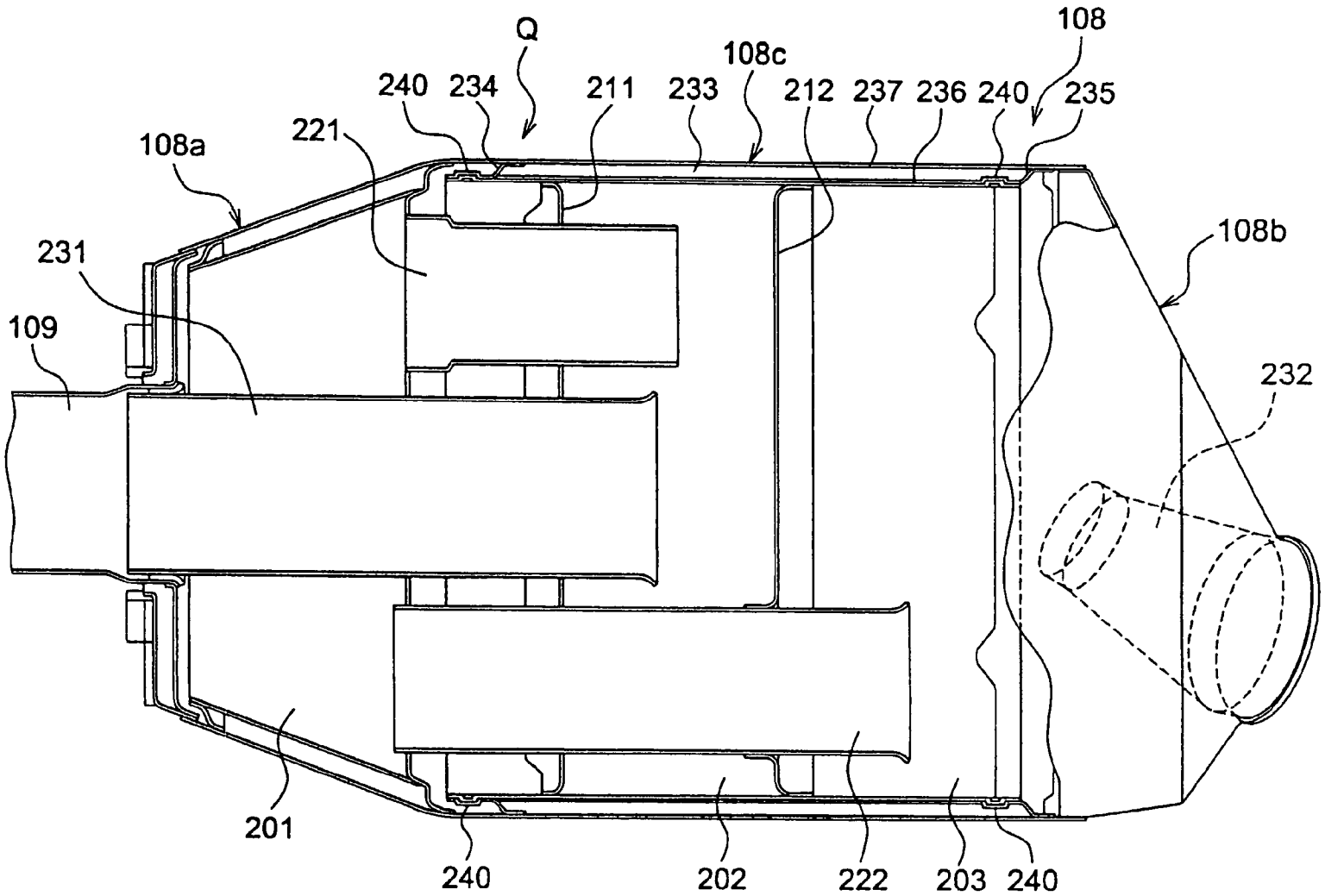
FIG. 4 is a sectional plan view of an exhaust muffler.
Figure 5:
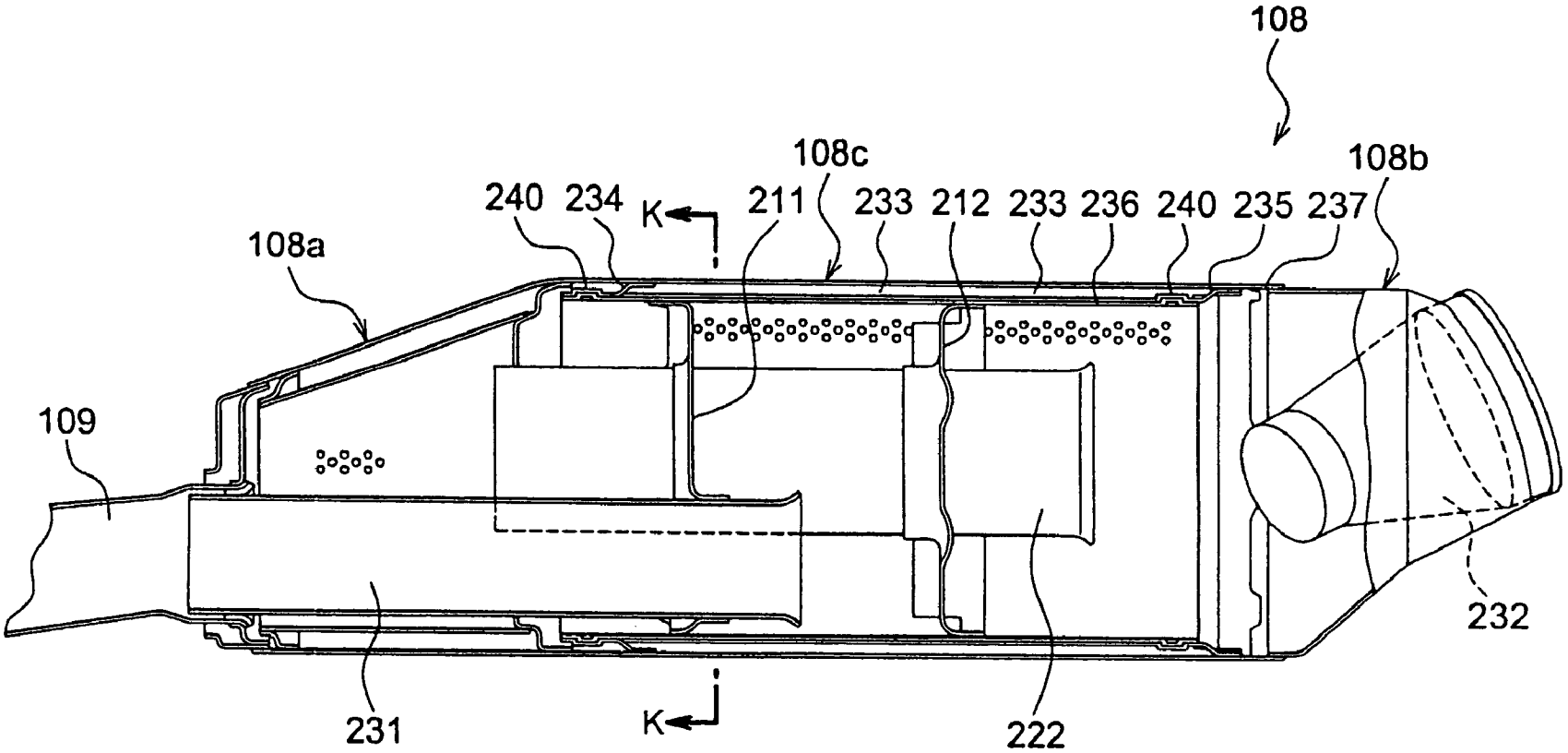
FIG. 5 is a sectional side view of the exhaust muffler.
Figure 6:
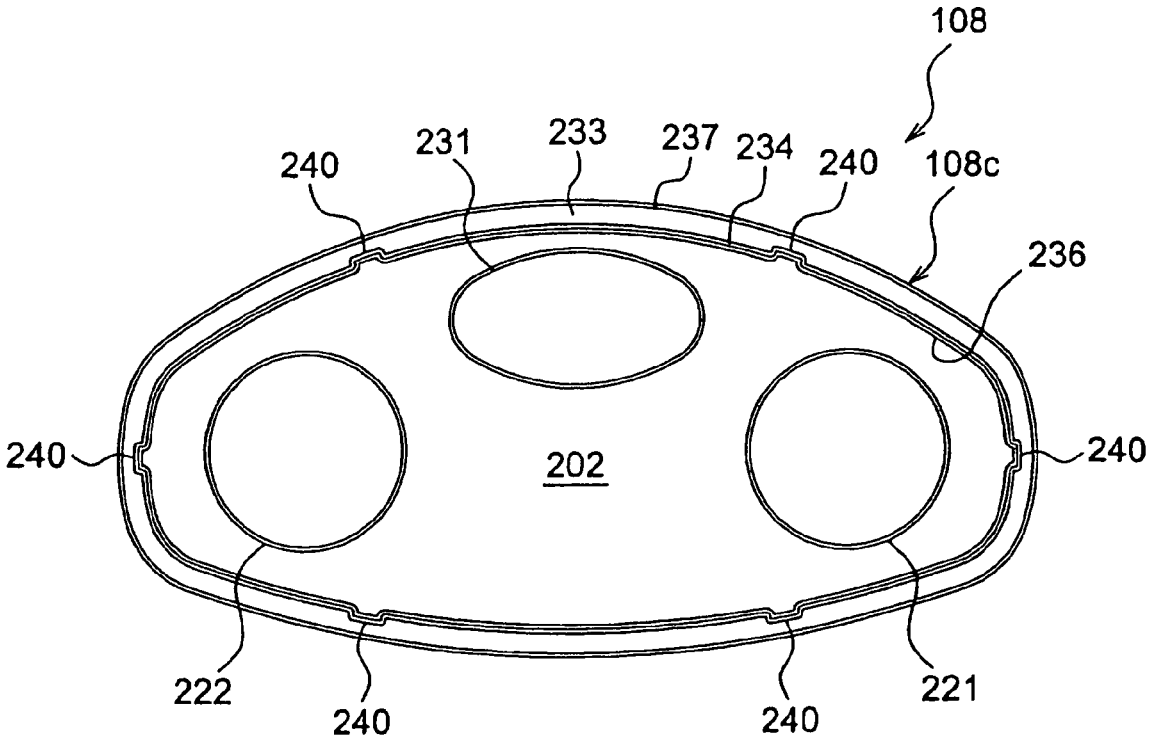
FIG. 6 is a cross section taken along the line K-K in FIG. 5, which corresponds to a cross section taken along a plane perpendicular to the longitudinal direction of the exhaust muffler.

FIG. 4 is a sectional plan view of the exhaust muffler 108, FIG. 5 is a sectional side view of the exhaust muffler 108, and FIG. 6 is a cross section taken along the line K-K in FIG. 5.

As shown in FIG. 4, the exhaust muffler 108 has a multistage (e.g., three-stage in FIG. 4) expansion chamber. The multistage expansion chamber is composed of three expansion chambers 201, 202, and 203 arranged in this order in the direction of flow of the exhaust gas. The exhaust muffler 108 includes two partition walls 211 and 212 for partitioning the three expansion chambers 201, 201, and 203, a first communication pipe 221 for making communication between the expansion chambers 202 and 201, a second communication pipe 222 for making communication between the expansion chambers 201 and 203, an inlet pipe 231 for connecting an exhaust pipe 109 to the expansion chamber 202 from the outside of the exhaust muffler 108, and an outlet pipe 232 for connecting the expansion chamber 203 to the outside of the exhaust muffler 108.

The exhaust gas from the exhaust pipe 109 is first fed through the inlet pipe 231 into the expansion chamber 202, next fed through the first communication pipe 221 into the expansion chamber 201, and next fed through the second communication pipe 222 into the expansion chamber 203. The exhaust gas is further discharged from the expansion chamber 203 through the outlet pipe 232 to the outside of the exhaust muffler 108.

The exhaust muffler 108 has a double-layer structure for suppressing noise generated from the inside of the exhaust muffler 108. More specifically, the exhaust muffler 108 is composed of an upstream portion 108*a*, a downstream portion 108*b*, and an intermediate portion 108*c* formed between the upstream portion 108*a* and the downstream portion 108*b*. As shown in FIG. 6, the intermediate portion 108*c* is composed of an inner cylinder 236 for forming the inner wall of the exhaust muffler 108 and an outer cylinder 237 for forming the outer wall of the exhaust muffler 108. The inner cylinder 236 and the outer cylinder 237 are spaced apart from each other, and the space between the inner cylinder 236 and the outer cylinder 237 is filled with a sound insulating material 233 such as glass wool.

The inner cylinder 236 is formed of a titanium material resistant to high temperatures, and the outer cylinder 237 is formed of a stainless steel material. Accordingly, it is difficult to weld the inner cylinder 236 to the outer cylinder 237, and two mounting members 234 and 235 are therefore interposed between the inner cylinder 236 and the outer cylinder 237. Thus, the inner cylinder 236 is mounted through the mounting members 234 and 235 to the outer cylinder 237.

Each of the partition walls 211 and 212 is bent along its outer circumference to form a flange portion, which is welded to the inner circumferential surface of the inner cylinder 236. These partition walls 211 and 212 are formed with through holes for insertion of the first and second communication pipes 221 and 222.

The mounting member 234 is a closed, flattened ring-like member located at the upstream end of the inner cylinder 236 so as to connect the outer circumferential surface of the inner cylinder 236 and the inner circumferential surface of the outer cylinder 237. Similarly, the mounting member 235 is a closed, flattened ring-like member located at the downstream end of the inner cylinder 236 so as to connect the outer circumferential surface of the inner cylinder 236 and the inner circumferential surface of the outer cylinder 237.

The mounting members 234 and 235 are connected by welding to the outer cylinder 237. On the other hand, the mounting members 234 and 235 are fixed to the inner cylinder 236 by button crimping at a plurality of (e.g., six in FIG. 6) portions spaced apart from each other in the circumferential direction.

Figure 7:
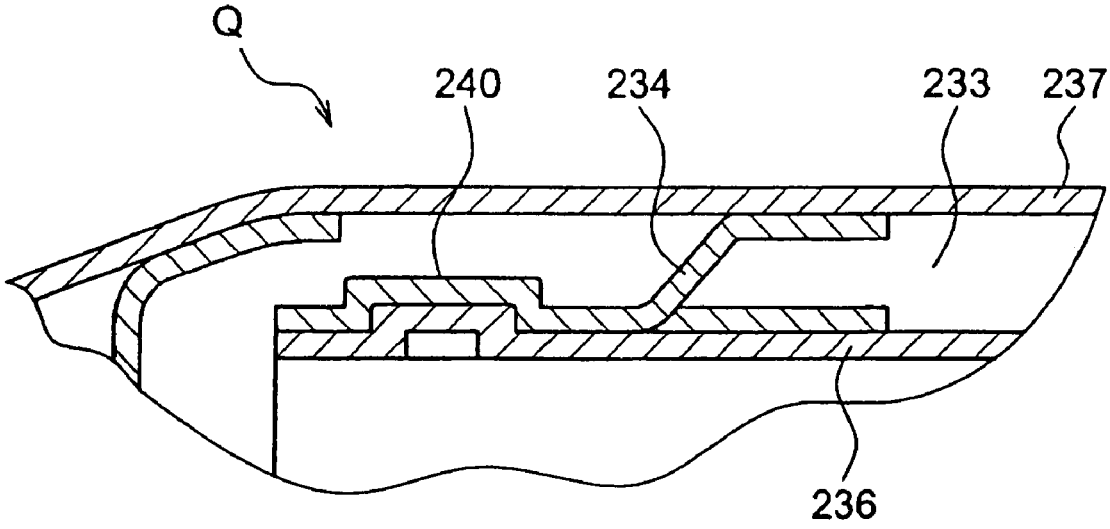
FIG. 7 is an enlarged view of a portion Q shown in FIG. 4.

FIG. 7 is an enlarged view of a portion Q shown in FIG. 4, showing one of the button crimped portions. In FIGS. 4 to 7, the button crimped portions are denoted by reference numerals 240.

Each button crimped portion 240 is formed by pressing the inner cylinder 236 on the mounting members 234 and 235 to crimp them together, thus fixing the inner cylinder 236 and the mounting members 234 and 235.

Figure 8:
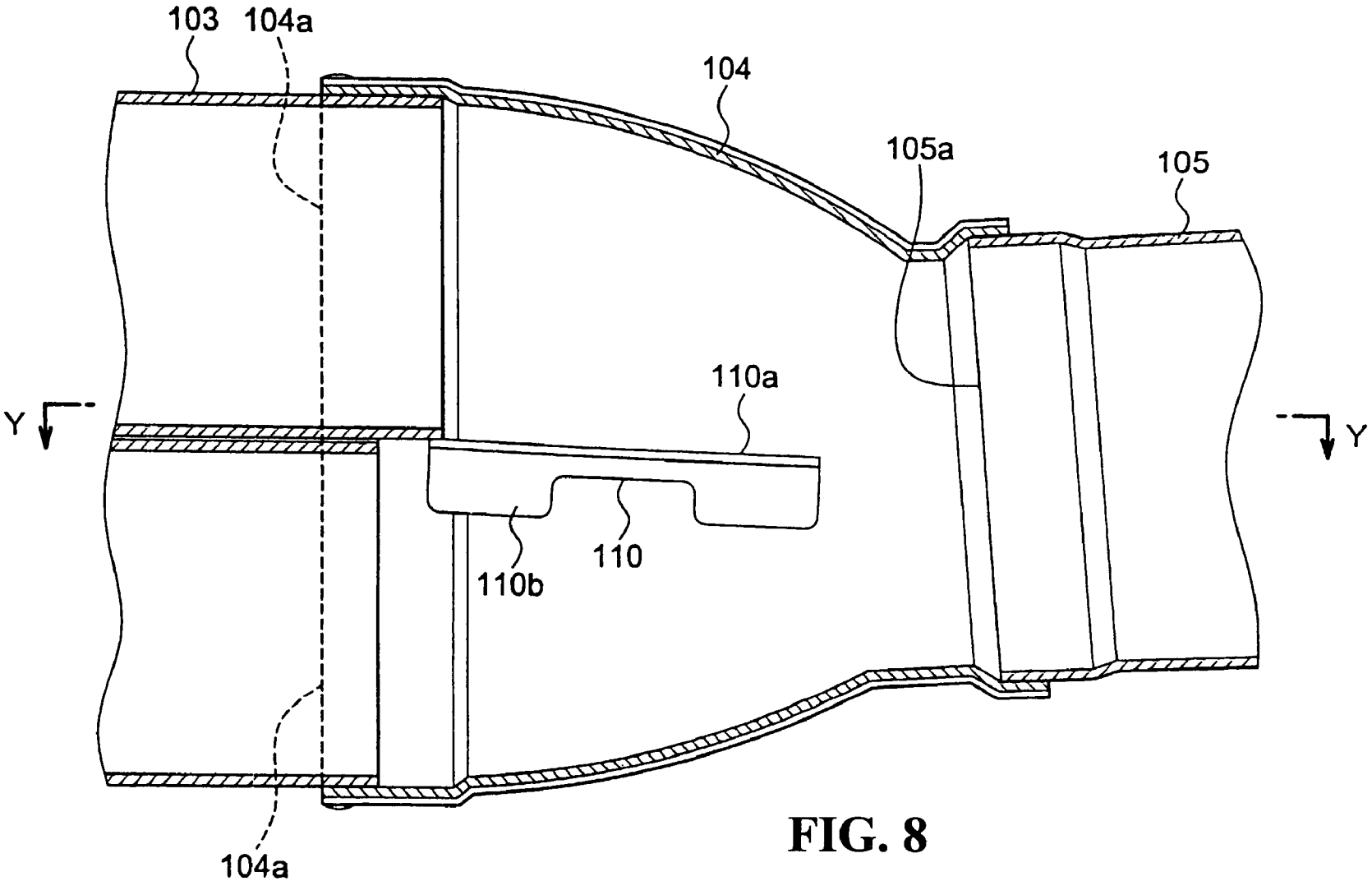
FIG. 8 is a cross section taken along the line X-X in FIG. 3, which is a sectional side view of a downstream exhaust manifold portion.
Figure 9:
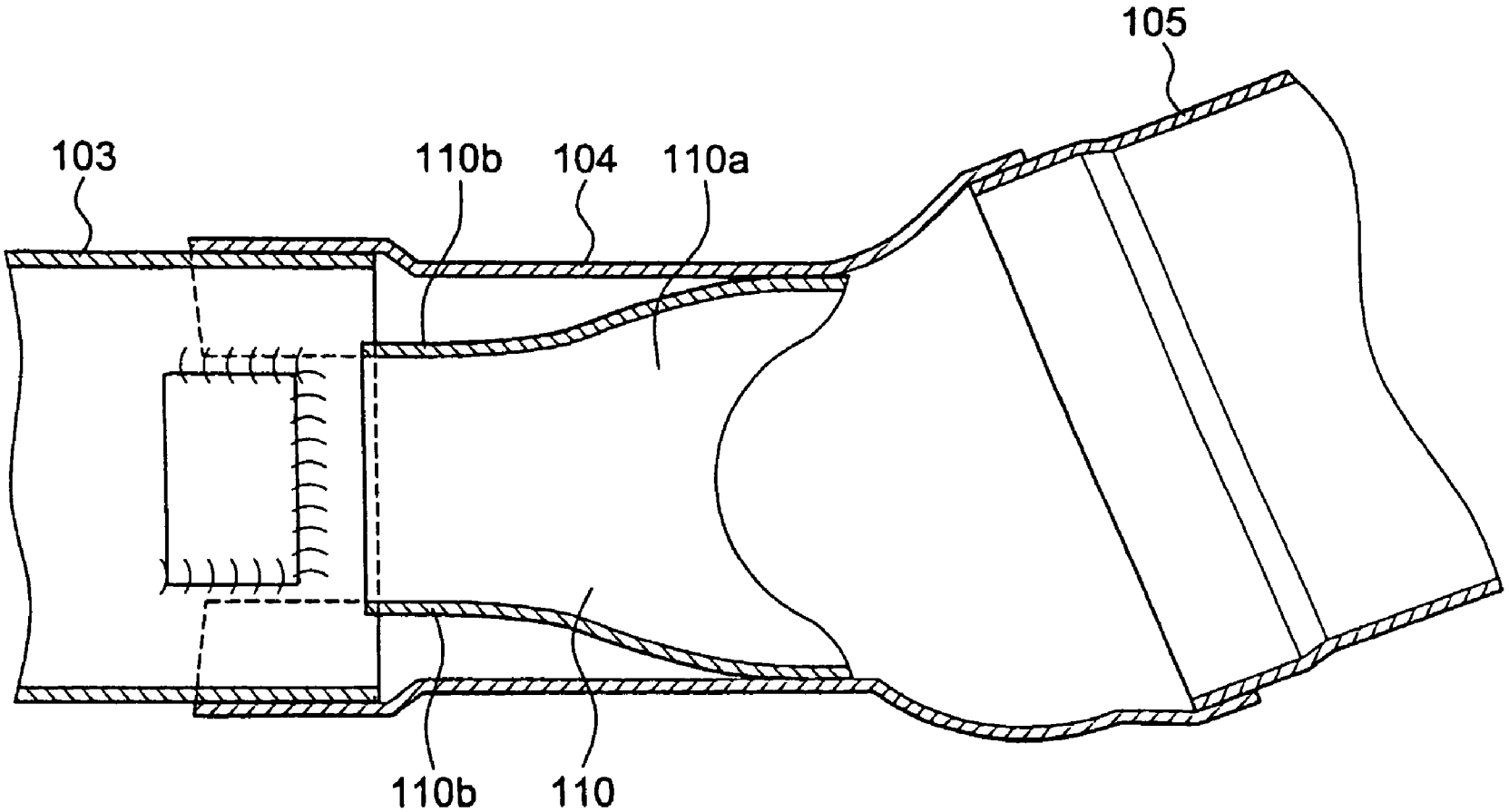
FIG. 9 is a cross section taken along the line Y-Y in FIG. 8, which is a sectional plan view of a separator.
Figure 10:
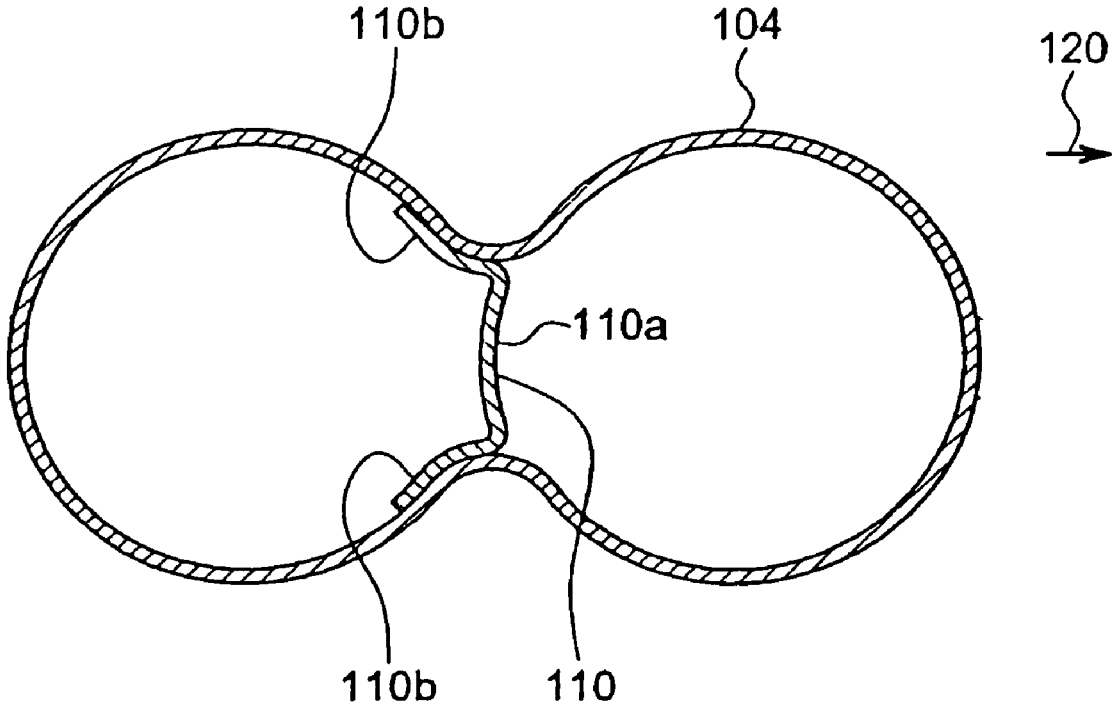
FIG. 10 is a cross section taken along the line P-P in FIG. 3, which corresponds to a cross section of the downstream exhaust manifold portion and the separator taken along a plane perpendicular to the flowing direction of exhaust gas.

There will now be described the separator and the exhaust control valve provided in the exhaust device according to the present embodiment. FIG. 8 is a cross section taken along the line X-X in FIG. 3, which is a sectional side view of the downstream exhaust manifold portion 104. FIG. 9 is a cross section taken along the line Y-Y in FIG. 8, wherein the upper side of the sheet of FIG. 9 corresponds to the upper side of the vehicle body. FIG. 10 is a cross section taken along the line P-P in FIG. 3.

The separator 110 is provided in the downstream exhaust manifold portion 104, and functions to guide the flows of exhaust gas from the two inlet openings 104*a* vertically arranged adjacent to each other and to gradually join the flows of exhaust gas. As shown in FIG. 10, the separator 110 is fabricated by bending a flat plate member along its opposite side edges. As shown in FIGS. 8 and 10, the separator 110 has an upper surface 110*a* arranged substantially horizontally. In FIG. 10, the upper surface 110*a* of the separator 110 is oriented in the direction shown by an arrow 120, which corresponds to the upper side of the vehicle body. As shown in FIG. 10, the upper surface 110*a* is slightly concaved toward the lower side of the vehicle body.

As shown in FIG. 9, the separator 110 (the upper surface 110*a* of the separator 110) has a substantially Y-shaped configuration as viewed in a plan view so that the downstream half portion of the separator 110 extends and is diverged toward the downstream end from the upper side (the intermediate exhaust pipe 103 side). The downstream end of the separator 110 is arcuately concaved.

The right and left side portions of the separator 110 (the upper and lower end portions as viewed in FIG. 9) are bent downward to form a pair of mounting portions 110*b* fitted to the inner wall of the downstream exhaust manifold portion 104. The mounting portions 110*b* are welded to the inner wall. Thus, the separator 110 is fixedly mounted in the downstream exhaust manifold portion 104.

Figure 11:
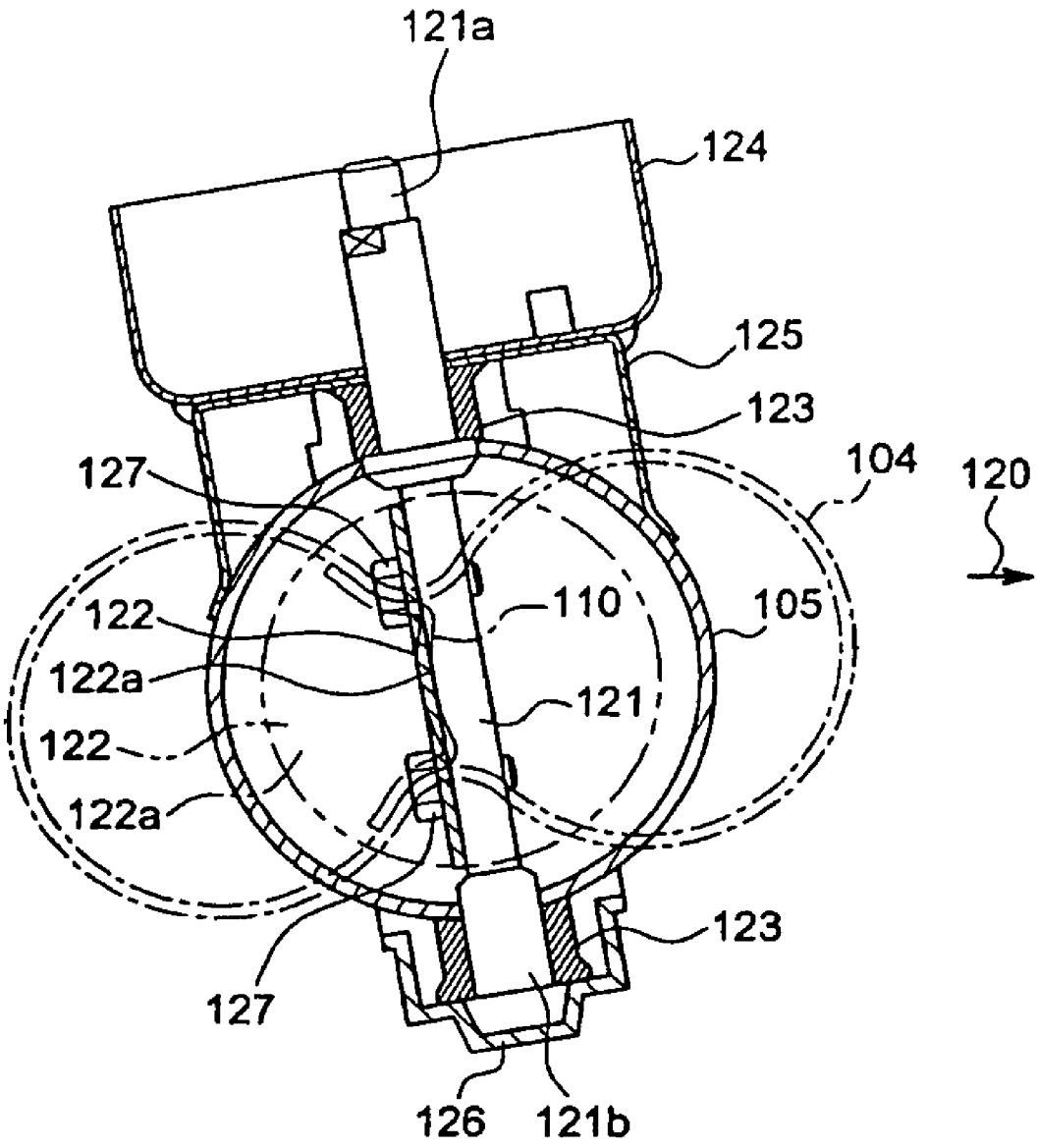
FIG. 11 is a cross section taken along the line Z-Z in FIG. 3, which is a cross section taken along a plane perpendicular to the longitudinal direction of a downstream exhaust pipe.

FIG. 11 is a cross section taken along the line Z-Z in FIG. 3, which is a sectional view of the downstream exhaust pipe 105 at a position where the exhaust control valve 122 is located. In FIG. 11, the sectional view of the downstream exhaust manifold portion 104 and the separator 110 shown in FIG. 10 is superimposed by a single dash line. Although the cross section taken along the line Z-Z and the cross section taken along the line P-P in FIG. 3 are not parallel to each other, these cross sections are viewed in parallel to each other in FIG. 11. Further, the arrow 120 shown in FIG. 11 (the rightward direction of FIG. 11) indicates the upper side of the vehicle body.

As shown in FIG. 11, a pivot shaft 121 is pivotably supported to the downstream exhaust pipe 105 so as to extend substantially horizontally along the diameter of the cross section of the downstream exhaust pipe 105, and the exhaust control valve 122 is fixedly mounted to the pivot shaft 121 so as to be pivotally rotated with the pivot shaft 121.

As shown in FIG. 11, the axis of rotation of the pivot shaft 121 is slightly inclined in the counterclockwise direction. The pivot shaft 121 extends through the wall of the downstream exhaust pipe 105 and is rotatably supported by a pair of bearings 123 provided on the outer circumference of the downstream exhaust pipe 105 at diametrically opposite positions. A body portion 124 of the exhaust control valve is provided on the outside of the upper bearing 123 as the left upper portion of the pivot shaft 121 in FIG. 11. The body portion 124 has a hollow box-shaped configuration opening to the upper side as viewed in FIG. 11. The body portion 124 is supported by a substantially U-shaped bracket 125 mounted on the outer circumference of the downstream exhaust pipe 105. One end portion 121*a* of the pivot shaft 121 extends into the body portion 124, so that the one end portion 121*a* of the pivot shaft 121 may be connected to a control motor (not shown) or the like for controlling the rotation of the pivot shaft 121. The other end portion 121*b* of the pivot shaft 121 is covered with a cap member 126.

As shown in FIG. 11, the exhaust control valve 122 is a so-called butterfly valve having a disc-shaped configuration (as shown by a double dash line in FIG. 11). The exhaust control valve 122 is fixed to the pivot shaft 121 by means of two fastening members 127 such as bolts. The exhaust control valve 122 is fully closed when a main surface 122*a* of the exhaust control valve 122 becomes perpendicular to the flowing direction of the exhaust gas in the downstream exhaust pipe (which direction corresponds to the direction perpendicular to the plane of the sheet of FIG. 11) as in the condition shown by the double dash line in FIG. 11. On the other hand, the exhaust control valve 122 is fully opened when the main surface 122*a* becomes parallel to the flowing direction of the exhaust gas in the downstream exhaust pipe 105 (as in the condition shown by a solid line in FIG. 11). The opening angle of the exhaust control valve 122 is adjustable between the fully open condition and the fully closed condition according to engine speed.

Further, the axis of rotation of the pivot shaft 121 extends substantially parallel to an extension plane of the upper surface 110*a* of the separator 110 (which extension plane corresponds to the plane extending from the upper surface 110*a* toward the pivot shaft 121). When the exhaust control valve 122 is in the fully open condition obtained by rotating the pivot shaft 121, the main surface 122*a* of the exhaust control valve 122 is substantially parallel to the extension plane of the upper surface 110*a* of the separator 110. The positional relation between the separator 110 provided in the downstream exhaust manifold portion 104 and the exhaust control valve 122 provided in the downstream exhaust pipe 105 is schematically shown by broken lines in FIG. 2. Also shown in FIG. 11, it should be understood that the separator 110 (shown by the single dash line) is substantially parallel to the exhaust control valve 122 (shown by the solid line).

The operation of the exhaust device according to this preferred embodiment will now be described.

As shown in FIG. 8, the flows of exhaust gas in the two intermediate exhaust pipes 103, vertically arranged adjacent to each other, enter the downstream exhaust manifold portion 104 and are passed above and below the separator 110. As shown in FIG. 8, the flows of exhaust gas above and below the separator 110 are gradually joined together on the downstream side of the separator 110.

The flows of exhaust gas on the downstream side of the separator 110 toward the exhaust control valve 122 have not yet been sufficiently joined together in the downstream exhaust pipe 105. That is, there yet remain the upper and lower flows of exhaust gas in the downstream exhaust pipe 105.

However, in the fully open condition of the exhaust control valve 122, the main surface 122*a* of the exhaust control valve 122 is substantially horizontal and substantially parallel to the upper surface 110*a* of the separator 110. Accordingly, the upper and lower flows of exhaust gas are passed above and below the exhaust control valve 122 with a low resistance. That is, the amount of exhaust gas striking the thickness of the disc forming the exhaust control valve 122 can be reduced, so that the exhaust gas is passed through the exhaust control valve 122 with a low exhaust resistance.

According to the exhaust device 100, in the fully open condition of the exhaust control valve 122 provided on the downstream side of the separator 110, the main surface 122*a* of the exhaust control valve 122 is substantially parallel to the upper surface 110*a* of the separator 110. Accordingly, the amount of exhaust gas striking the thickness of the disc forming the exhaust control valve 122 can be reduced, so that the exhaust gas smoothly flows through the exhaust control valve 122 with a low exhaust resistance. As a result, the exhaust efficiency in the fully open condition of the exhaust control valve 122 can be improved.

The exhaust control valve 122 is rotatably supported to the pivot shaft 121 extending diametrically through the downstream exhaust pipe 105 located on the downstream side of the downstream exhaust manifold portion 104, and the axis of rotation of the pivot shaft 121 extends parallel to the extension plane of the upper surface 110*a* of the separator 110. Accordingly, the main surface 122*a* of the exhaust control valve 122 can be easily made parallel to the upper surface 110*a* of the separator 110 by simply rotating the pivot shaft 121.

The $O_2$ sensor 107 is located at the inside portion 106*c* of the bent portion of the bent exhaust pipe 106, and the detecting portion is exposed to the inner wall of the inside portion 106*c*. Accordingly, the exhaust gas in the bent exhaust pipe 106 flows mainly along the inner wall of an outside portion opposite to the inside portion 106*c* because of a centrifugal force, so that the condensation staying in the pipe hardly splashes on the detecting portion. As a result, possible trouble or improper detection by the $O_2$ sensor 107 due to the condensation can be prevented.

The intermediate portion 108*c* of the exhaust muffler 108 has a double-layer structure composed of the inner cylinder 236 and the outer cylinder 237. Further, the two mounting members 234 and 235 are interposed between the inner cylinder 236 and the outer cylinder 237 to connect them together. The mounting members 234 and 235 are fixed to the inner cylinder 236 by button crimping. Thus, although the inner cylinder 236 and the outer cylinder 237 cannot be welded to each other from the viewpoint of material, the cylinders 236 and 237 can be easily fixed together through the mounting members 234 and 235. Accordingly, the double-layer structure can be obtained without complication of the structure of the exhaust muffler 108.

The outer cylinder 237 is fixed to the mounting members 234 and 235 by welding, and the inner cylinder 236 is fixed to the mounting members 234 and 235 by button crimping. Accordingly, the surface of the outer cylinder 237 exposed to the appearance is not formed with any projections and recesses caused by button crimping, so that the appearance of the exhaust muffler 108 is not damaged.

Having thus described a specific preferred embodiment of the present invention, it should be noted that the present invention is not limited to the above preferred embodiment, but various modifications and changes may be made without departing from the scope of the present invention.

In the above preferred embodiment, the two intermediate exhaust pipes 103 are vertically arranged adjacent to each other, and the upper surface 110*a* of the separator 110 is substantially horizontal. Further, the main surface 122*a* of the exhaust control valve 122 in its fully open condition is substantially horizontal. However, it is not essential to make the upper surface 110*a* and the main surface 122*a* to be substantially horizontal. It is only necessary to make the upper surface 110*a* and the main surface 122*a* to be substantially parallel to each other in the fully open condition of the exhaust control valve 122. For example, in the case wherein the two intermediate exhaust pipes 103 are horizontally arranged adjacent to each other, it is sufficient that the upper surface 110*a* of the separator 110 and the main surface 122*a* of the exhaust control valve 122 become substantially vertical and substantially parallel to each other. Also in this case, the amount of exhaust gas striking the thickness of the disc forming the exhaust control valve 122 can be reduced, so that the exhaust gas smoothly flows through the exhaust control valve 122 with a low exhaust resistance.

Similarly, the mounting angle of the pivot shaft 121 is not limited, provided that the axis of rotation of the pivot shaft 121 becomes parallel to the extension plane of the upper surface 110*a* of the separator 110.

Further, the outer circumferential portion of the exhaust control valve 122 may be chamfered to reduce the thickness. Accordingly, the exhaust resistance of the exhaust gas flowing through the exhaust control valve 122 can be further reduced.

While only the intermediate portion 108*c* of the exhaust muffler 108 has a double-layer structure adopting button crimping, the upstream portion 108*a* and/or the downstream portion 108*b* of the exhaust muffler 108 may also have a double-layer structure adopting button crimping.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust device for a motorcycle including an engine having a plurality of cylinders comprising:

a plurality of upstream exhaust pipes respectively connected to exhaust ports for said cylinders;

an exhaust control valve provided in a downstream exhaust pipe; and a separator provided in an exhaust manifold portion of said exhaust pipe for gradually joining the flows of exhaust gas;

wherein said exhaust control valve is located on a downstream side of said separator so that a main surface of said exhaust control valve, in its fully open condition, becomes substantially parallel to a main surface of said separator whereby the amount of an exhaust gas striking a thickness of the exhaust control valve is reduced, creating a low exhaust resistance and wherein the separator includes the main surface that is arranged substantially horizontally and is substantially parallel to the exhaust control valve in a fully open position, the main surface being concaved towards a lower side of a vehicle body.

2. The exhaust device for the motorcycle according to claim 1, wherein said exhaust control valve is rotatably supported to a pivot shaft extending diametrically through said downstream exhaust pipe located on the downstream side of said exhaust manifold portion, and the axis of rotation of said pivot shaft extends parallel to an extension plane of said main surface of said separator.

3. The exhaust device for the motorcycle according to claim 1, wherein the separator is operatively positioned within the one downstream exhaust pipe and is operatively arranged adjacent to the exhaust control valve.

4. The exhaust device for the motorcycle according to claim 1, wherein the plurality of exhaust pipes are connected with two upstream exhaust manifold portions for connecting the plurality of exhaust pipes to two intermediate exhaust pipes.

5. The exhaust device for the motorcycle according to claim 4, wherein the two intermediate exhaust pipes are connected with a downstream exhaust manifold portion for connecting two intermediate into one downstream exhaust pipe.

6. The exhaust device for the motorcycle according to claim 1, and further including an $O_2$ sensor operatively connected to a bent portion of the exhaust pipe disposed downstream from the exhaust control valve for detecting if combustion is performed at a stoichiometric air-fuel ration.

7. The exhaust device for the motorcycle according to claim 6, wherein the $O_2$ sensor is operatively connected on an inside portion of the bent portion of the exhaust pipe to prevent condensation from being splashed thereon.

8. The exhaust device for the motorcycle according to claim 1, wherein the separator further includes mounting portions bent relative to the main surface for fitting relative to an inner wall of the downstream exhaust manifold.

9. The exhaust device for the motorcycle according to claim 8, wherein the mounting portions of the separator are fixedly mounted relative to the downstream exhaust manifold for aligning the main surface of the separator relative to the exhaust control valve when the exhaust control valve is in a fully open condition.

10. An exhaust device adapted to be used with an engine having a plurality of cylinders comprising:

a plurality of upstream exhaust pipes;

an exhaust manifold portion operatively connected to said plurality of upstream exhaust pipes for combining a flow of exhaust gas therein;

an exhaust control valve provided in a downstream exhaust pipe; and a separator provided in the exhaust manifold portion of said exhaust pipe for separating the flows of exhaust gas as the exhaust gas flows towards the exhaust control valve;

said exhaust control valve being located on a downstream side of said separator wherein a main surface of said exhaust control valve in its fully open condition becomes substantially parallel to a main surface of said separator and wherein the separator includes the main surface that is arranged substantially horizontally and is substantially parallel to the exhaust control valve in a fully open position, the main surface being concaved downwardly.

11. The exhaust device adapted to be used with an engine according to claim 10, wherein said exhaust control valve is rotatably supported to a pivot shaft extending diametrically through said downstream exhaust pipe located on the downstream side of said exhaust manifold portion, and the axis of rotation of said pivot shaft extends parallel to an extension plane of said main surface of said separator.

12. The exhaust device adapted to be used with an engine according to claim 10, wherein the separator is operatively positioned within the one downstream exhaust pipe and is operatively arranged adjacent to the exhaust control valve.

13. The exhaust device adapted to be used with an engine according to claim 10, wherein the plurality of exhaust pipes are connected with two upstream exhaust manifold portions for connecting the plurality of exhaust pipes to two intermediate exhaust pipes.

14. The exhaust device adapted to be used with an engine according to claim 13, wherein the two intermediate exhaust pipes are connected with a downstream exhaust manifold portion for connecting two intermediate into one downstream exhaust pipe.

15. The exhaust device adapted to be used with an engine according to claim 10, and further including an $O_2$ sensor operatively connected to a bent portion of the exhaust pipe disposed downstream from the exhaust control vale for detecting if combustion is performed at a stoichiometric air-fuel ration.

16. The exhaust device adapted to be used with an engine according to claim 15, wherein the $O_2$ sensor is operatively connected on an inside portion of the bent portion of the exhaust pipe to prevent condensation from being splashed thereon.

17. The exhaust device adapted to be used with an engine according to claim 10, wherein the separator further includes mounting portions bent relative to the main surface for fitting relative to an inner wall of the downstream exhaust manifold.

18. The exhaust device adapted to be used with an engine according to claim 17, wherein the mounting portions of the separator are fixedly mounted relative to the downstream exhaust manifold for aligning the main surface of the separator relative to the exhaust control valve when the exhaust control valve is in a fully open condition.

19. An exhaust device for a motorcycle including an engine having a plurality of cylinders comprising:

a plurality of upstream exhaust pipes respectively connected at their one end to exhaust ports for said cylinders and at their other end to a downstream exhaust manifold portion, a separator fixedly mounted on the exhaust manifold portion to guide and gradually join the flows of exhaust gas on the downstream side of the separator, said separator having a substantially Y-shaped configuration so that the downstream half portion of the separator is extended and diverged toward the downstream end from the upper side and an exhaust control valve provided on a downstream side of the separator, said exhaust control valve being fixedly mounted to a pivot shaft so as to be pivotally rotated with the pivot shaft whereby when a main surface of the exhaust control valve is in its fully open condition, it becomes substantially parallel to a main surface of the separator.

20. An exhaust device for a motorcycle including an engine having a plurality of cylinders comprising:

a plurality of upstream exhaust pipes respectively connected to exhaust ports for said cylinders;

an exhaust control valve provided in a downstream exhaust pipe; and a separator provided in an exhaust manifold portion of said exhaust pipe for gradually joining the flows of exhaust gas, said separator having a substantially Y-shaped configuration so that the downstream half portion of the separator is extended and diverged toward the downstream and from the upper side;

wherein said exhaust control valve is located on a downstream side of said separator so that a main surface of said exhaust control valve, in its fully open condition, becomes substantially parallel to a main surface of said separator whereby the amount of an exhaust gas striking a thickness of the exhaust control valve is reduced, creating a low exhaust resistance.

* * * * *